US006705374B2

(12) United States Patent
Yu Chen

(10) Patent No.: US 6,705,374 B2
(45) Date of Patent: Mar. 16, 2004

(54) ADHESIVE-TAPE CUTTING DEVICE OF AN ADHESIVE-TAPE HOLDER

(76) Inventor: Hsiu-Man Yu Chen, No. 27, Sec. 1, Dafu Rd., Tantz Shiang, Taichung (TW), 427

( * ) Notice: Subject to any disclaimer, the term of this patent is extended or adjusted under 35 U.S.C. 154(b) by 129 days.

(21) Appl. No.: 10/106,354

(22) Filed: Mar. 27, 2002

(65) Prior Publication Data

US 2003/0183060 A1 Oct. 2, 2003

(51) Int. Cl.[7] ..... B32B 31/00

(52) U.S. Cl. ..... 156/527; 156/577; 156/579; 225/23; 225/56; 225/77; 225/91

(58) Field of Search ..... 156/577, 579, 156/576, 527, 523, 526; 225/23, 21, 20, 56, 77, 91

(56) References Cited

U.S. PATENT DOCUMENTS 5,725,726 A * 3/1998 Yu ..... 156/577

* cited by examiner

*Primary Examiner*—Richard Crispino
*Assistant Examiner*—Cheryl N. Hawkins
(74) *Attorney, Agent, or Firm*—Troxell Law Office PLLC

(57) ABSTRACT

An adhesive-tape cutting device of an adhesive-tape holder has a position-limiting device provided between the vertical short side of a slide base and the push plate portion of a press plate. The position-limiting device is composed of two position-limiting holes bored on the vertical short side of the slide base and two insert studs fixed on the push plate portion of the press plate, and the two insert studs respectively received in the two position-limiting holes to prevent the slide base from sliding leftward or rightward.

4 Claims, 5 Drawing Sheets

ADHESIVE-TAPE CUTTING DEVICE OF AN ADHESIVE-TAPE HOLDER

BACKGROUND OF THE INVENTION

This invention relates to an adhesive-tape cutting device of an adhesive-tape holder, particularly to one having a position-limiting device provided between the vertical short side of a slide base and the push plate of a flattening plate to prevent the slide base from sliding leftward or rightward.

The adhesive-tape holder disclosed in the Taiwan Patent No. 090220363, titled "ADHESIVE-TAPE CUTTING DEVICE OF AN ADHESIVE-TAPE HOLDER", need not be provided with any fixing device between a flattening plate and a support rod as well as a slide base, not only saving force in operation, but saving producing cost and facilitating assembling as well. However, the structure of such an adhesive-tape cutting device still leaves something to be desired.

However, the press plate in the adhesive-tape cutting device of an adhesive-tape holder just mentioned above has no securing means, so the object of this invention is to improve this drawback.

SUMMARY OF THE INVENTION

The objective of the invention is to offer an adhesive-tape cutting device of an adhesive-tape holder, provided with a position-limiting device between the vertical short side of a slide base and the push plate of a flattening plate to restrict the position of the slide base not to slide leftward or rightward.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
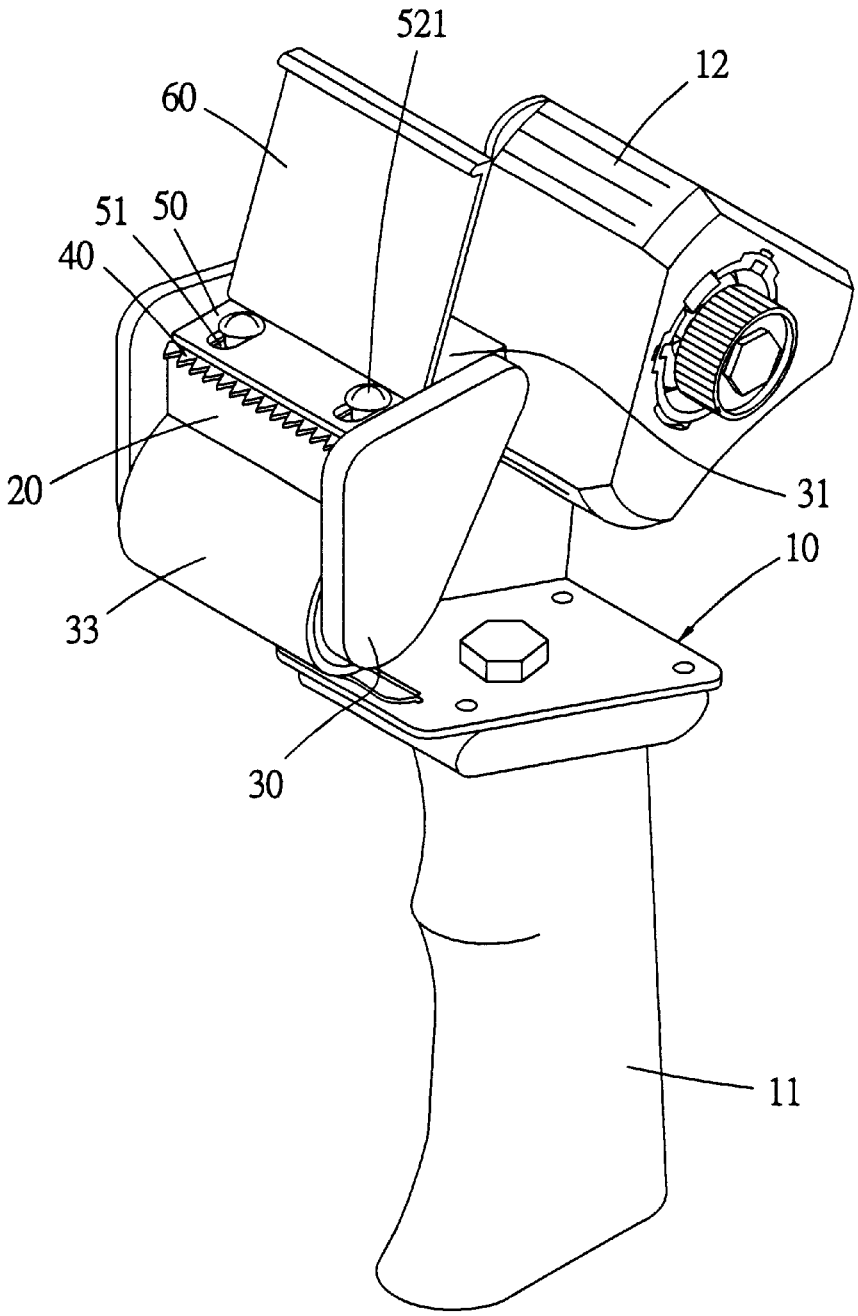
FIG. 1 is a perspective view of an adhesive-tape cutting device of an adhesive-tape holder in the present invention.

One preferred embodiment of an adhesive-tape cutting device of an adhesive-tape holder in the present invention, as shown in FIGS. 1, 2, 3 and 4, includes an adhesive-tape holder 10, a blade holder 20, two side plates 30, a blade 40, a slide base 50 and a press plate 60 as main components combined together.

The adhesive-tape holder 10 has a handle 11 formed under and an adhesive-tape base 12 disposed on a side edge.

The blade holder 20 is formed with a fixing member 21 on one end to be engaged with one end of the adhesive-tape holder 10 (not shown). The blade holder 10 is provided with two fixing studs 22 respectively having a threaded hole 23, a receiving groove 25 in the center and two slide grooves 24 respectively at the left side and the right side of the receiving groove 25.

The two side plates 30 respectively have a column-shaped support rod 31 and a pivotal shaft 32 provided at a proper position above and below the blade holder 20 to be combined together with the adhesive-tape holder 10, with the support rod 31 formed with an arcuate surface 311, and the pivotal shaft 32 fitted around with a roller 33. The two side plates 30 and the blade holder 20 are formed integral or combined together by inserting or screwing.

The blade 40 is mounted on the blade holder 20, having two oval slide holes 41 for respectively receiving two fixing studs 22 of the blade holder 20 and move so that the blade 40 may move forward and backward therein. The blade 40 is further provided with two fixing holes 42 matching with two slide grooves 24 of the blade holder 20.

The slide base 50 is fitted on the blade 40 to activate the blade 40 to shift together forward and backward. The slide base 50 is formed with two oval slide holes 51 in the upper surface to match with two slide holes 41 of the blade 40 so as to let two bolts 52 respectively screw through the slide holes 51, 41 and then fixedly fastened with the threaded holes 23 of the blade holder 20. Nevertheless, the bottom side 522 of the head 521 of the bolt 52 doesn't tightly contact with the upper surface of the slide base 50 in order to allow the blade 40 and the slide base 50 to slide back and forth therein. In addition, the slide base 50 is L-shaped and formed with a vertical short side 501 provided with a projecting stud 53 on the inner wall, and a spring 54 having one end fitted around the projecting stud 53 and the other end inserted in the receiving groove 25 of the blade holder 20. The slide base 50 is further provided at a bottom side with two positioning studs 55 protruding downward and respectively inserted through the positioning holes 42 of the blade 40 and then extending in the slide grooves 24 of the blade holder 20.

The press plate 60 is formed with a vertical push plate portion 62 at the lower end for pushing against the vertical short side 501 of the slide base 50, having a curved support member 61 formed between the press plate 60 and the vertical push plate portion 62 to closely rest on the support rod 31 of side plate 30.

A key point of improvement in the invention is a position limit device, which consists of two position-limiting holes 56 respectively bored at opposite sides of the projecting stud 53 of the vertical short side 501 of the slide base 50, and two insert studs 63 provided in the press plate 60 and respectively fixed on opposite ends of its vertical push plate portion 62 to be received in the two position-limiting holes 56, so that the press plate 60 and the slide base 50 are restricted in a position not to slide leftward or rightward. Further, the diameter of the position-limiting hole 56 of the slide base 50 is larger than that of the insert stud 63 of the press plate 60, letting the insert stud 63 able to move properly in the position-limiting hole 56.

In assembling, firstly, the blade 40 and the slide base 50 are orderly disposed on the blade holder 20 to let the slide holes 41, 51 of the blade 40 and the slide base 50 fit around the fixing studs 22 of the blade holder 20 and then screwed together by means of the bolts 52. The bolts 52 are screwed simply for keeping the blade 40 and the slide base 50 in place, but let the bottom sides 522 of their heads 521 not tightly touch the top surface of the slide base 50 so as to permit the slide holes 41 and 51 able to slide along the fixing studs 22, and thus the slide base 50 and the blade 40 can merely shift back and forth.

At the same time, the positioning studs 55 of the slide base 50 are respectively inserted through the positioning holes 42 of the blade 40 and then get into the slide grooves 24 of the blade holder 20 to enable the blade 40 and the slide base 50 to move together. Additionally, the spring 54 has its two ends respectively push against the projecting stud 53 and the receiving groove 25, therefore the slide base 50 can be forced to recover quickly by the resilient force of the spring 54.

Next, the press plate 60 has its curved support member 61 inserted sideward in between the slide base 50 and the arcuate surface 311 of the support rod 31 of the side plate 30, letting the support member 61 rest closely on the arcuate surface 311 of the support rod 31. Then, the insert studs 63 of the push plate 62 are respectively inserted in the position-limiting holes 56 of the slide base 50, rendering the press plate 60 and the slide base 50 unable to slide leftward or rightward.

Lastly, the blade holder 20 has its fixing member 21 fixedly combined with the adhesive-tape holder 10, and in the meantime the left side plate 30 together with the blade holder 20 is stably fixed on the adhesive-tape holder 10 by means of screws (not shown) to finish assembling an adhesive-tape cutting device.

Figure 4:
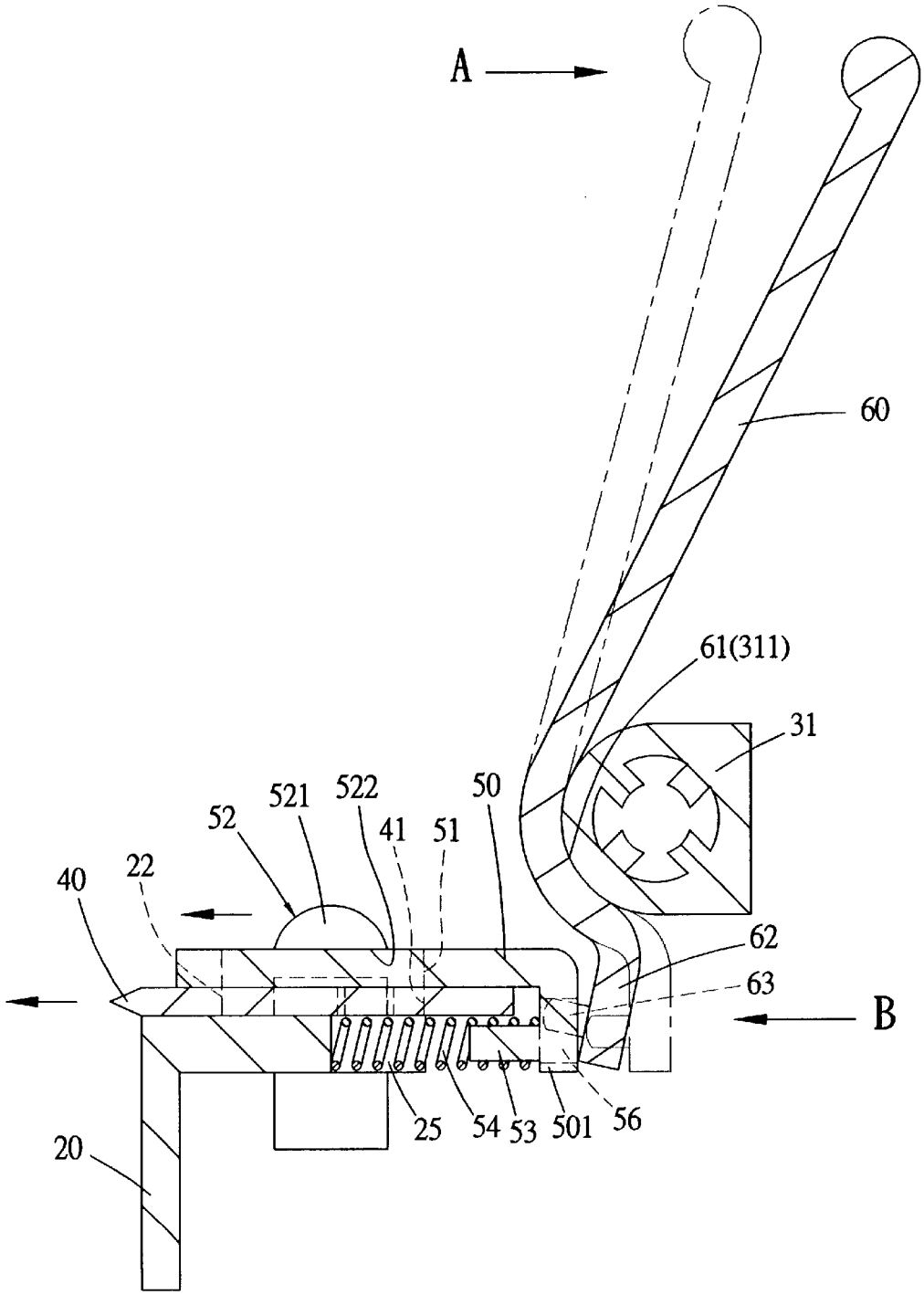
FIG. 4 is a side cross-sectional view of the first preferred embodiment of the adhesive-tape cutting device in an operating condition in the present invention.

In using, as shown in FIG. 4, the adhesive tape on the adhesive-tape base 12 is pulled out to pass through the roller 33 and get onto the flattening plate 60. Afterward, the adhesive tape is glued on the article to be adhered and then turns around the roller 33 to let the adhesive tape pulled out smoothly and synchronously pushed down by the end edge of the press plate 60. To cut off the adhesive tape, just forcefully press down the handle 11 to let the adhesive tape laid on the article being adhered, and as a result an action (A) will occur on the top end of the press plate 60 and synchronously a reaction (B) will be produced on the push plate portion 62 to push against the slide base 50, because the support rod 31 of the side plate 30 propping up the support member 61 serves as a fulcrum. As the reaction (B) is larger than the resilient force of the spring 54, the push plate portion 62 is forced to push the slide base 50 together with the blade 40 to move forward to cut off the adhesive tape.

On the contrary, in case of releasing the handle 11, the slide base 50 together with the blade 40 will quickly recover its original position by the resilient force of the spring 54, thus ensuring safety in using.

Figure 2:
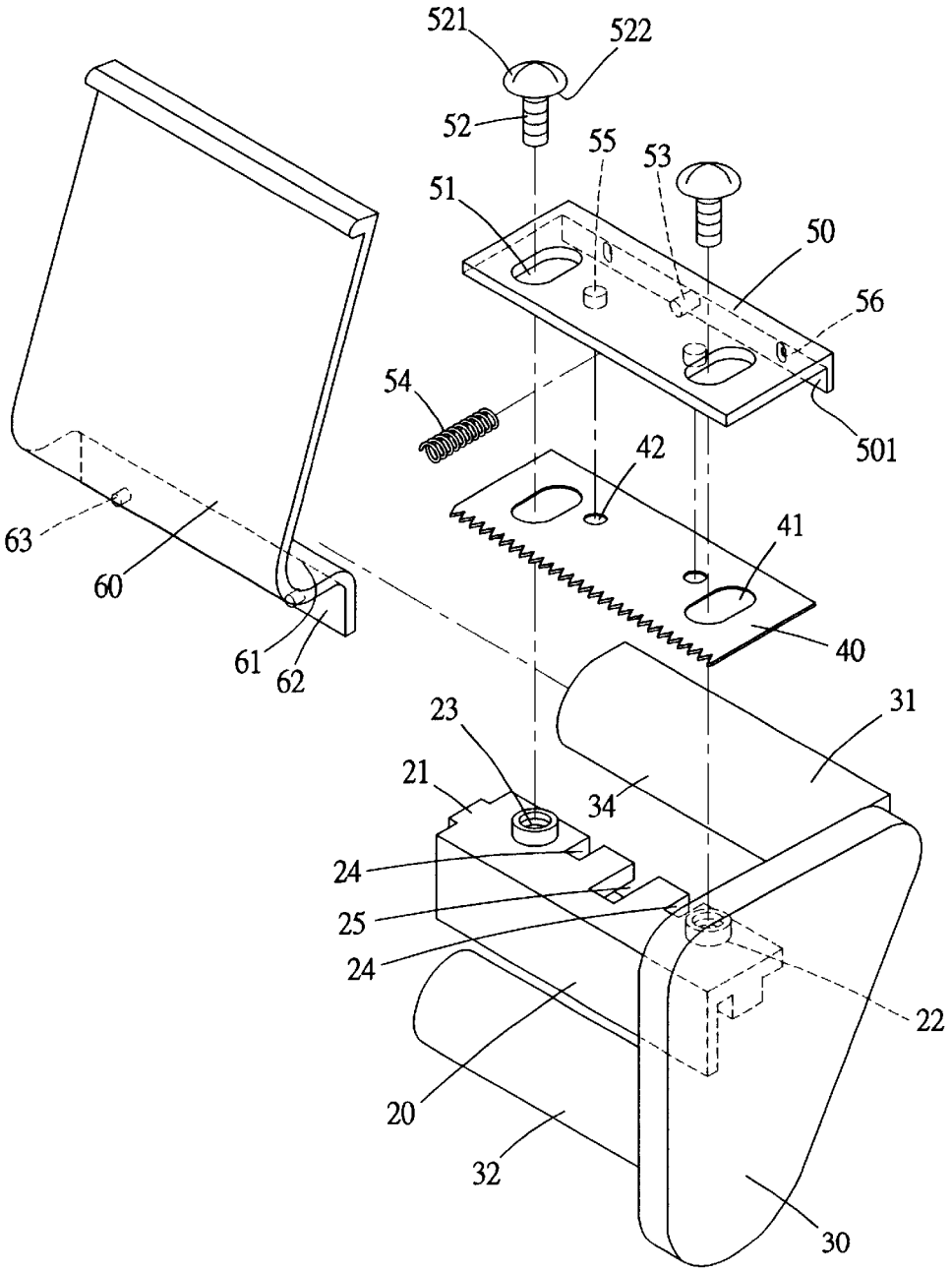
FIG. 2 is an exploded perspective view of a first preferred embodiment of the adhesive-tape cutting device of an adhesive-tape holder in the present invention.
Figure 3:
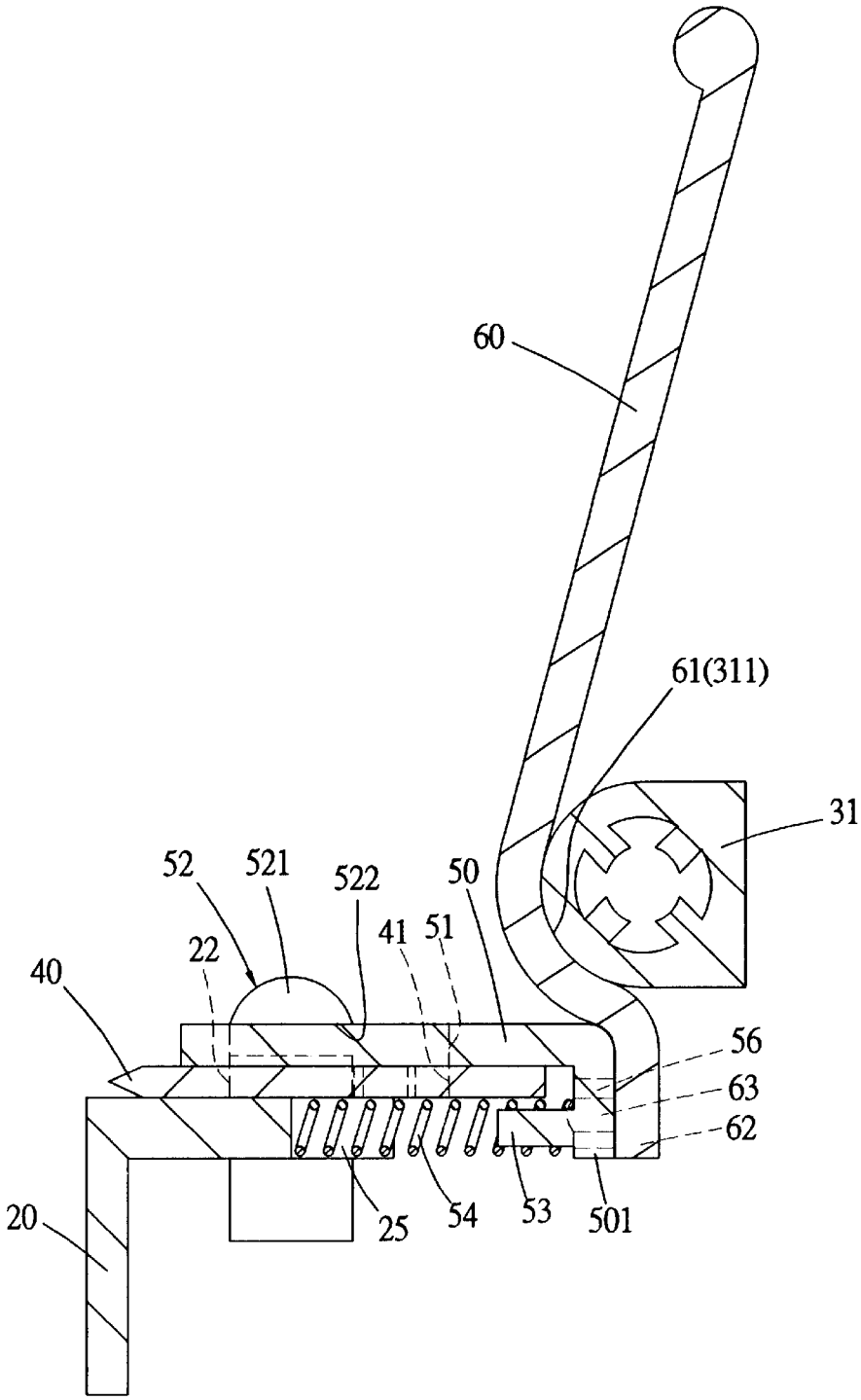
FIG. 3 is a side cross-sectional view of the first preferred embodiment of the adhesive-tape cutting device assembled in the present invention.

The first preferred embodiment of a position-limiting device in the present invention, as shown in FIG. 2, is to have the push plate portion 62 provided with the two insert studs 63 respectively received in two position-limiting holes 56 of the slide base 50 to prevent the press plate 60 and the slide base 50 from sliding leftward or rightward.

Figure 5:
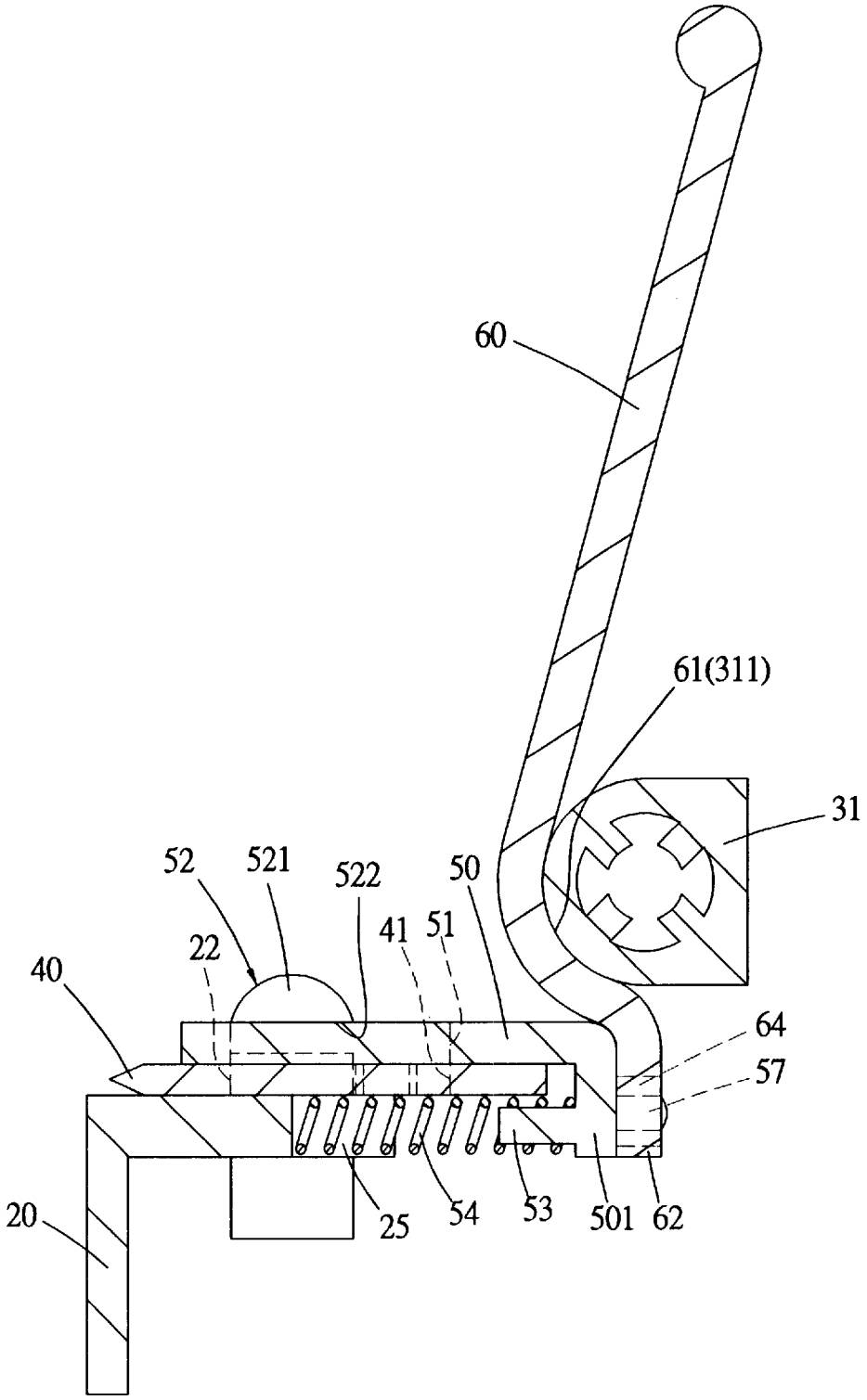
FIG. 5 is a side cross-sectional view of a second preferred embodiment of the adhesive-tape cutting device assembled in the present invention.

A second preferred embodiment of a position-limiting device in the present invention, as shown in FIG. 5, is to have the vertical short side 501 of the slide base 50 provided with two insert studs 57, and have the push plate 62 of the flattening plate 60 bored with two position-limiting holes 64 for respectively receiving the two insert studs 57, equally making the press plate 60 and the slide base 50 unable to slide sideward.

While the preferred embodiments have been described above, it will be recognized and understood that various modifications may be made therein and the appended claims are intended to cover all such modifications that may fall within the spirit and scope of the invention.

I claim:

1. An adhesive-tape cutting device of an adhesive-tape holder comprising:

an adhesive-tape holder having a handle under an adhesive-tape base and a left side plate provided on a left end, a pivotal shaft provided at a proper position of said left side plate and fixed with said adhesive-tape holder, said pivotal shaft fitted around with a roller;

a support rod fixed at a proper position of said left side plate;

a blade holder positioned on one end of said adhesive-tape holder and provided on top with two fixing studs respectively having a threaded hole, said blade holder further bored with a receiving groove in the center and two slide grooves respectively on the left side and the right side of said receiving groove;

a blade mounted on said blade holder and provided with two slide holes matching with said two threaded holes of said blade holder, said two slide holes respectively fitted around said two fixing studs of said blade holder, said blade further having two positioning holes corresponding to said two slide grooves of said blade holder;

a slide base mounted on said blade to activate said blade to shift back and forth, said slide base having two slide holes on an upper surface to match with said two slide holes of said blade, a projecting stud fixed on an inner wall of a vertical short side of the slide base and a spring having one end fitted around said projecting stud and the other end inserted in said receiving groove of said blade holder, said slide base further provided with two fixing studs protruding downward to be respectively inserted through said two fixing holes of said blade and into said slide grooves of said blade holder;

a press plate formed with a vertical push plate portion at a lower end, said vertical push plate portion pushing against said slide base, a curved support member formed between said vertical push plate portion and the rest of said plate to closely rest on said support rod of said side plate; and a position-limiting device provided between said vertical short side of said slide base and said push plate portion of said press plate to prevent said slide base from sliding leftward or rightward, said position-limiting device including two position-limiting holes bored on said vertical short side of said slide base and two insert studs secured on said push plate of said press plate, said two insert studs respectively received in said two position-limiting holes.

2. The adhesive-tape cutting device of an adhesive-tape holder as claimed in claim 1, wherein the diameter of said position-limiting holes of said slide base are larger than that of said insert studs of said press plate.

3. The adhesive-tape cutting of an adhesive-tape holder as claimed in claim 1, wherein said support rod of said side plate is formed with an arcuate surface for said support member of said press plate to rest thereon.

4. An adhesive-tape cutting device of an adhesive-tape holder comprising:

an adhesive-tape holder having a handle under an adhesive-tape base and a left side plate provided on a left end, a pivotal shaft provided at a proper position of said left side plate and fixed with said adhesive-tape holder, said pivotal shaft fitted around with a roller;

a support rod fixed at a proper position of said left side plate;

a blade holder positioned on one end of said adhesive-tape holder and provided on top with two fixing studs respectively having a threaded hole, said blade holder further bored with a receiving groove in the center and two slide grooves respectively on the left side and the right side of said receiving groove;

a blade mounted on said blade holder and provided with two slide holes matching with said two threaded holes of said blade holder, said two slide holes respectively fitted around said two fixing studs of said blade holder, said blade further having two positioning holes corresponding to said two slide grooves of said blade holder;

a slide base mounted on said blade to activate said blade to shift back and forth, said slide base having two slide holes on an upper surface to match with said two slide holes of said blade, a projecting stud fixed on an inner wall of a vertical short side of the slide base and a spring having one end fitted around said projecting stud and the other end inserted in said receiving groove of said blade holder, said slide base further provided with two fixing studs protruding downward to be respectively inserted through said two fixing holes of said blade and into said slide grooves of said blade holder;

a press plate formed with a vertical push plate portion at a lower end, said vertical push plate portion pushing against said slide base, a curved support member formed between said vertical push plate portion and the rest of said plate to closely rest on said support rod of said side plate; and a position-limiting device provided between said vertical short side of said slide base and said push plate portion of said press plate to prevent said slide base from sliding leftward or rightward, said position-limiting device including two position-limiting holes provided on said push plate portion of said press plate and two insert studs secured on said vertical short side of said slide base, said two position-limiting holes respectively receiving said two insert studs.

* * * * *